US007806474B2

(12) United States Patent
Wahl et al.

(10) Patent No.: US 7,806,474 B2
(45) Date of Patent: Oct. 5, 2010

(54) CONNECTING ARRANGEMENT FOR ARTICLES OF FURNITURE

(75) Inventors: Mark A. Wahl, Gentryville, IN (US); Joshua A. Peter, Jasper, IN (US); Joshua R. Butcher, Washington, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 12/353,630

(22) Filed: Jan. 14, 2009

(65) Prior Publication Data

US 2010/0176634 A1 Jul. 15, 2010

(51) Int. Cl.
*A47C 1/124* (2006.01)

(52) U.S. Cl. ..... 297/248

(58) Field of Classification Search ..... 297/248, 297/440.1

See application file for complete search history.

(56) References Cited

U.S. PATENT DOCUMENTS 2,466,204 A * 4/1949 Brown ..... 297/115
3,011,227 A * 12/1961 Vogel ..... 297/248
3,614,158 A 10/1971 Mohr
3,637,256 A * 1/1972 Harty ..... 297/248
3,669,494 A * 6/1972 Lohmeyer ..... 297/440.14
3,742,869 A 7/1973 Polsky et al.
3,841,701 A 10/1974 Sullivan
3,944,281 A * 3/1976 Piretti ..... 297/440.14
4,077,666 A * 3/1978 Heumann ..... 297/440.14
4,591,289 A 5/1986 Vickers et al.
4,668,011 A * 5/1987 Fister, Jr. ..... 297/218.5
4,802,422 A 2/1989 Beard
4,978,168 A 12/1990 Piretti
5,259,165 A 11/1993 Koyama
5,282,669 A 2/1994 Barile
5,352,017 A 10/1994 Berning
5,544,938 A 8/1996 Saul et al.
5,673,881 A 10/1997 Minchey et al.
5,857,742 A * 1/1999 Karl et al. ..... 297/248
5,957,530 A 9/1999 Gutgsell
6,048,127 A 4/2000 Kern et al.
6,485,219 B1 11/2002 Beyer et al.
6,543,845 B2 4/2003 Seitz et al.
6,749,259 B2 6/2004 Ware et al.

(Continued)

*Primary Examiner*—Peter R. Brown
(74) *Attorney, Agent, or Firm*—Baker & Daniels LLP

(57) ABSTRACT

A connecting arrangement for articles of furniture, such as seating furniture and/or tables of the type used in an office environment. A pair of articles of furniture are positioned adjacent to one another, each including a downwardly-opening channel along a lower portion of its side. An elongate connector spans the distance between the channels and has opposite side portions in respective engagement with the channels to connect the furniture articles together in a manner wherein the connector may be visually hidden in use. If one, or both, of the connected articles of furniture includes upholstered sides, the upholstery is compressed upon abutting engagement of the articles of furniture to generate a separation force which is resisted by the connector and aids in maintaining the connector in secure engagement with the channels of the adjacent articles of furniture. The connector may have substantially the same length as a distance between front and rear legs of the articles of furniture, such that the connector is engageable with the front and/or rear legs to restrain movement of the articles of furniture in a front-to-back direction with respect to one another.

17 Claims, 4 Drawing Sheets

U.S. PATENT DOCUMENTS 6,932,428 B2 8/2005 Murphy
7,347,493 B2 3/2008 Mulmed
7,481,496 B2 * 1/2009 Smith ..... 297/440.14
2005/0253430 A1 * 11/2005 George et al. ..... 297/248
2007/0210631 A1 * 9/2007 Berning et al. ..... 297/248
2008/0041281 A1 2/2008 Griepentrog

* cited by examiner

CONNECTING ARRANGEMENT FOR ARTICLES OF FURNITURE

BACKGROUND OF THE INVENTION

1. Field of the Invention

The present invention relates to articles of furniture and, in particular, relates to a connecting arrangement for connecting articles of furniture to one another, such as seating furniture of the type used in an office environment, including chairs, lounges, and tables.

2. Description of the Related Art

Office environments typically include chairs and lounges, together with side tables, for use in conference rooms, waiting rooms, and at other locations within the office environment. The chairs typically include a single seat, while lounges typically include one-, two-, and/or three-seat versions. Side tables may be placed next to the chairs and/or lounges.

A wide variety of connecting arrangements are known for connecting or "ganging" adjacent chairs or lounges to one another, and/or for connecting side tables to the chairs and/or lounges. Some chairs, lounges and/or tables include structures integrated into the articles of furniture for connecting the articles of furniture together. Other arrangements include structurally separate connectors, such as brackets, which are fastened to the undersides of the furniture articles by screws or other fasteners with the use of tools. One disadvantage with this arrangement is that the furniture articles may need to be tilted on their sides, or even up-ended, to allow installation of the brackets. In any event, the brackets are typically difficult to install beneath the furniture when the furniture is in its use orientation. The brackets may also be visible between the adjacent furniture articles, and may therefore detract from the aesthetic appearance of the furniture.

What is needed is a connecting arrangement for articles of furniture, such as seating furniture, which is an improvement over the foregoing.

SUMMARY OF THE INVENTION

The present invention provides a connecting arrangement for articles of furniture, such as seating furniture and/or tables of the type used in an office environment. A pair of articles of furniture are positioned adjacent to one another, each including a downwardly-opening channel along a lower portion of its side. An elongate connector spans the distance between the channels and has opposite side portions in respective engagement with the channels to connect the furniture articles together in a manner wherein the connector may be visually hidden in use. If one, or both, of the connected articles of furniture includes upholstered sides, the upholstery is compressed upon abutting engagement of the articles of furniture to generate a separation force which is resisted by the connector and aids in maintaining the connector in secure engagement with the channels of the adjacent articles of furniture. The connector may have substantially the same length as a distance between front and rear legs of the articles of furniture, such that the connector is engageable with the front and/or rear legs to restrain movement of the articles of furniture in a front-to-back direction with respect to one another.

In one form thereof, the present invention provides a furniture assembly, including a first article of furniture including a first side, and a lower portion having a downwardly-opening first channel adjacent the first side; a second article of furniture including a second side, and a lower portion having a downwardly-opening second channel adjacent the second side, the first and second sides of the first and second articles of furniture disposed adjacent one another; and a connector spanning a distance between the first and second channels, the connector having opposite side portions in respective engagement with the first and second channels.

In another form thereof, the present invention provides a furniture assembly, including a first article of furniture including a first side having compressible upholstery, and a lower portion having a first channel adjacent the first side; a second article of furniture including a second side, and a lower portion having a second channel adjacent the second side, the upholstery of the first side of the first article of furniture in compressive abutment with the second side of the second article of furniture; and a connector spanning a distance between the first and second channels, the connector having opposite side portions in respective engagement with the first and second channels; whereby a separating force between the first and second articles of furniture is generated by the compressive abutment of the upholstery of the first article of furniture with the second side of the second article of furniture, the separating force restrained by the connector.

In a further form thereof, the present invention provides a furniture assembly, including a first article of furniture including a first side with a lower portion having front and rear legs, and a first channel adjacent the first side and extending between the front and rear legs; a second article of furniture including a second side with a lower portion having front and rear legs, and a second channel extending between the front and rear legs, the first and second sides of the first and second articles of furniture disposed adjacent one another; and a connector spanning a distance between the first and second channels and having opposite side portions in respective engagement with the first and second channels, the connector having a length substantially equal to a length of the first and second channels, whereby the connector is engageable with the front and rear legs to restrain relative movement of the first and second articles of furniture along a direction parallel to the first and second channels.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figures 1A, 1B:
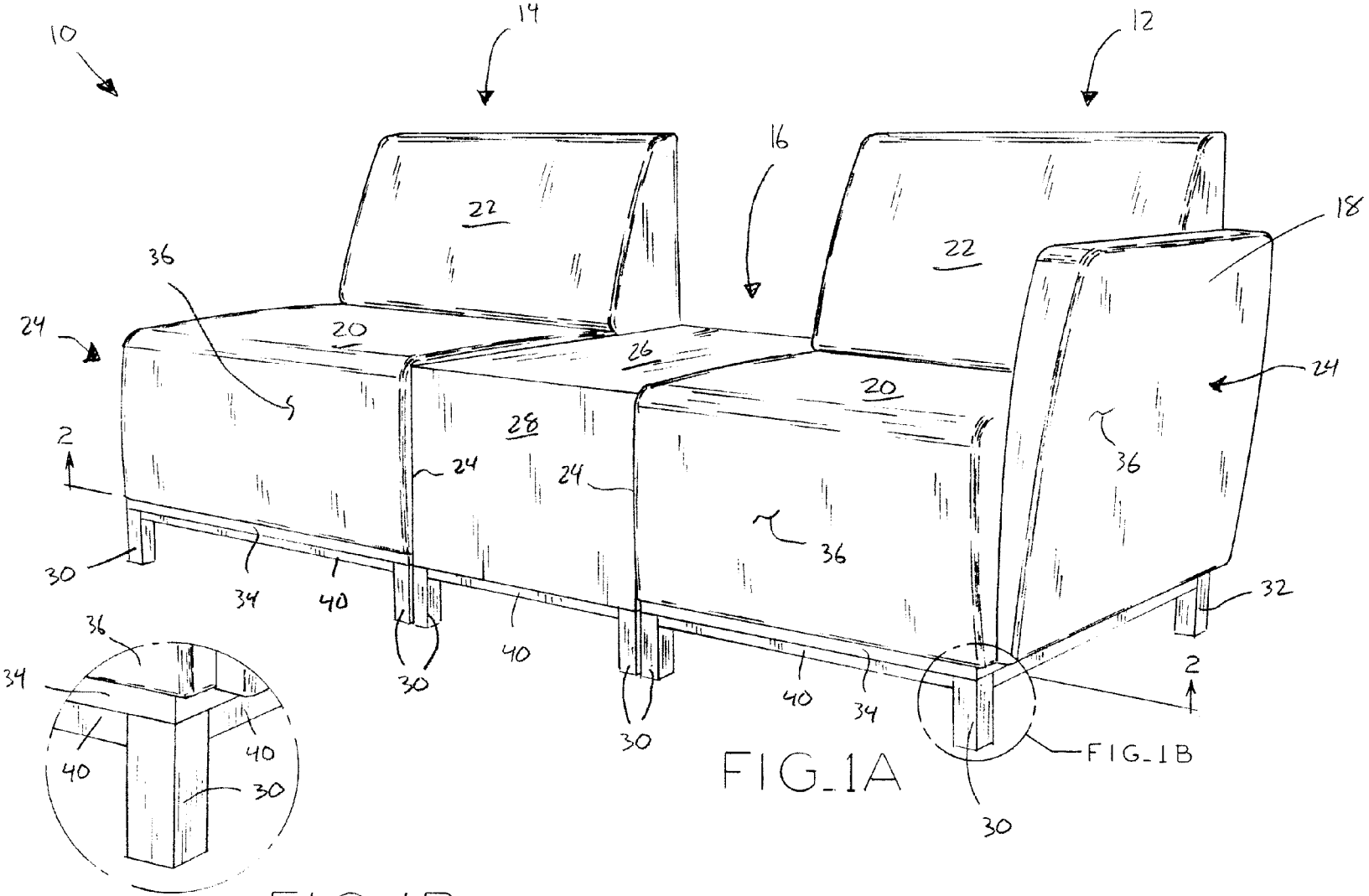
FIG. 1A is a perspective view of an exemplary furniture arrangement, including a pair of single seat lounges with a table in between the lounges.
FIG. 1B is an enlarged fragmentary view of the area around a front leg of one of the lounges of the furniture arrangement of FIG. 1A.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION

Referring to FIG. 1A, an exemplary furniture arrangement 10 is shown for use in an office environment, for example. Although furniture arrangement 10 is shown and described herein as an arrangement of seating furniture for use in an office environment, the connecting arrangement disclosed herein may optionally be used with other types of furniture, such as cabinets, tables, beds, etc., and may also be used with articles of furniture in other environments, such as in hotel waiting rooms, living rooms, bedrooms, etc.

Furniture arrangement 10 includes a first, single-seat chair or lounge 12, a second single-seat chair or lounge 14, and a table 16 disposed between lounge 12 and lounge 14. Lounge 12 is configured as an end lounge and includes arm 18, while lounge 14 is armless. Lounges 12 and/or 14 may optionally be sized as two- or three-seat lounges, for example. Lounges 12 and 14 each include a seat portion 20, a backrest portion 22, and a pair of opposite side portions 24 which, as described above, may be formed with or without arms 18. Table 16 has a cube-like profile including tabletop 26 and four sides 28.

Figure 2:
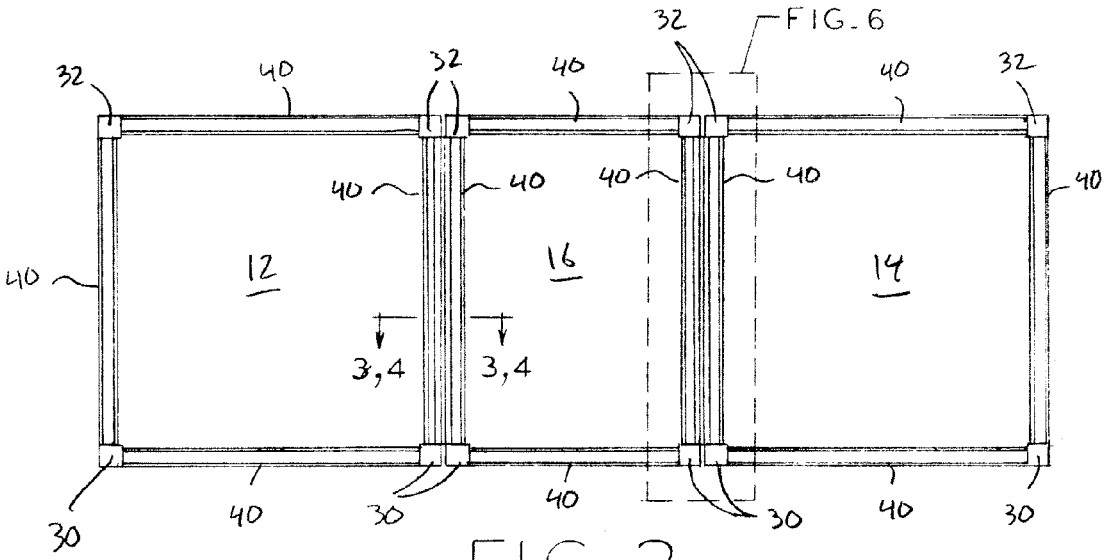
FIG. 2 is a bottom view of the furniture arrangement of FIG. 1A, viewed along line 2-2 of FIG. 1A.
Figure 3:
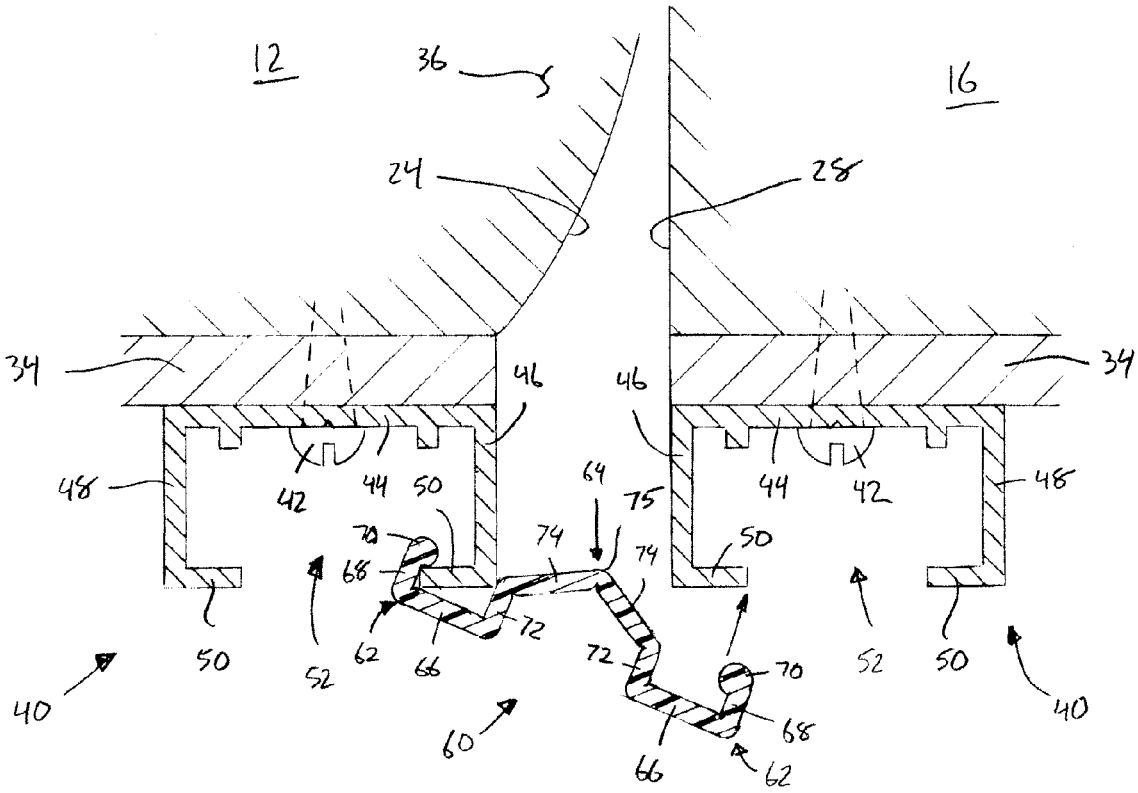
FIG. 3 is a sectional view taken along line 3-3 of FIG. 2, illustrating initial installation of the connector within a pair of channels mounted to the lower side portions of a lounge and table of the furniture arrangement of FIG. 1A.

Referring additionally to FIGS. 1B, 2, and 3, each of lounges 12 and 14 and table 16 include a pair of front legs 30 and a pair of rear legs 32, as well as a trim portion or section 34, each of which are exposed and may be made of wood, metal, or another suitable material. Lounges 12 and 14 may also include upholstery 36, described in further detail below. Lounges 12 and 14 and table 16 also include channels 40 of the type shown in FIG. 3, which are secured to trim sections 34 beneath the lower side edges of the articles of furniture as described below, such that channels 40 are disposed adjacent the lower sides of the articles of furniture, and extend between respective pairs of front and rear legs 30 and 32, as shown in FIG. 2. Lounges 12 and 14 and table 16 may additionally include channels 40 between their respective pairs of front and rear legs 30 and 32, as desired.

Referring to FIGS. 2 and 3, lounges 12 and 14 and table 16 may be arranged adjacent to one another and may be connected by a connecting arrangement described in detail below. It should be understood that lounges 12 and 14, and/or tables 16 may be connected to one another in various configurations. For example, a pair of lounges 12 and/or 14 may be connected to one another, a pair of tables 16 may be connected to one another, or any arrangement of lounges 12 and/or 14 and tables 16 may be connected as desired.

Referring to FIG. 3, channels 40 may be formed as elongate metal extrusions, for example, and are mounted via screws 42 to trim sections 34 as shown, or are otherwise securely mounted beneath the side edges of lounges 12 and 14 and table 16. Channels 40 open downwardly, and each include horizontal upper wall 44, an outer vertical wall 46 and an inner vertical wall 48 depending from upper wall 44, and lower edges including a pair of inwardly-depending lip portions 50 extending horizontally inwardly from the lower ends of outer and inner walls 46 and 48, respectively. Openings 52 are defined between lip portions 50 of each channel, with openings 52 facing downwardly, as shown.

Connector 60 may be formed of an elongate extrusion of a resilient plastic material, for example, and generally includes a pair of side portions 62 and a central bridging portion 64. As may be seen in FIG. 3, side portions 62 each include horizontal portion 66 and vertical portion 68, which together define a profile which is complementary to that of inwardly-depending lip portions 50 of channels 40, such that side portions 62 fit closely about inwardly-depending lip portions 50 of channels 40. Side portions 62 also each include a bead 70 at the end of vertical portion 68, which aids in the engagement and retention of connector 60 with channels 40. Central portion 64 of connector 60 includes an arched or peaked profile including vertical walls 72 and angled walls 74 connected to one another at an apex or hinge 75, such that vertical walls 72 and angled walls 74 may flex inwardly and outwardly relative to one another, and central portion 64 is dimensioned for receipt between adjacent channels 40 as shown in FIGS. 3-5 and described below.

To connect adjacent articles of furniture, such as lounge 12 and table 16 as shown in FIG. 3, lounge 12 and table 16 are positioned proximate or adjacent to one another, and a first side portion 62 of connector 60 is inserted within the opening 52 in channel 40 of lounge 12, such that bead 70 of that side portion 62 engages behind inwardly-depending lip portion 50 of outer wall 48 of channel 40 of lounge 12. Thereafter, the opposite arm portion 62 of connector 60 is inserted within the opening 52 in channel 40 of table 16, such that bead 70 of that arm portion 62 engages behind inwardly-depending lip portion 50 of outer wall 48 of channel 40 of table 16. Of course, the foregoing sequence could be reversed. As the second of the side portions 62 of connector 60 engages around the inwardly-depending lip portion 50 of its respective channel 40, the vertical and/or angled walls 72 and 74 of central portion 64 of connector may flex toward and away from one another as needed about hinge 75, such that the arm portion 62 may snap into channel 40 under tension depending on the distance between lounge 12 and table 16 and/or the compression of the upholstery 36 of lounge 12 as discussed below. In this manner, installation of connector 60 may draw lounge 12 and table 16 toward one another. As may be seen from FIG. 4, in the installed condition of connector 60, beads 70 of side portions 62 engage around inwardly-depending lip portions 50, with central portion 64 of connector received between outer walls 48 of the adjacent channels 40 to securely connect lounge 12 and table 16.

Figure 4:
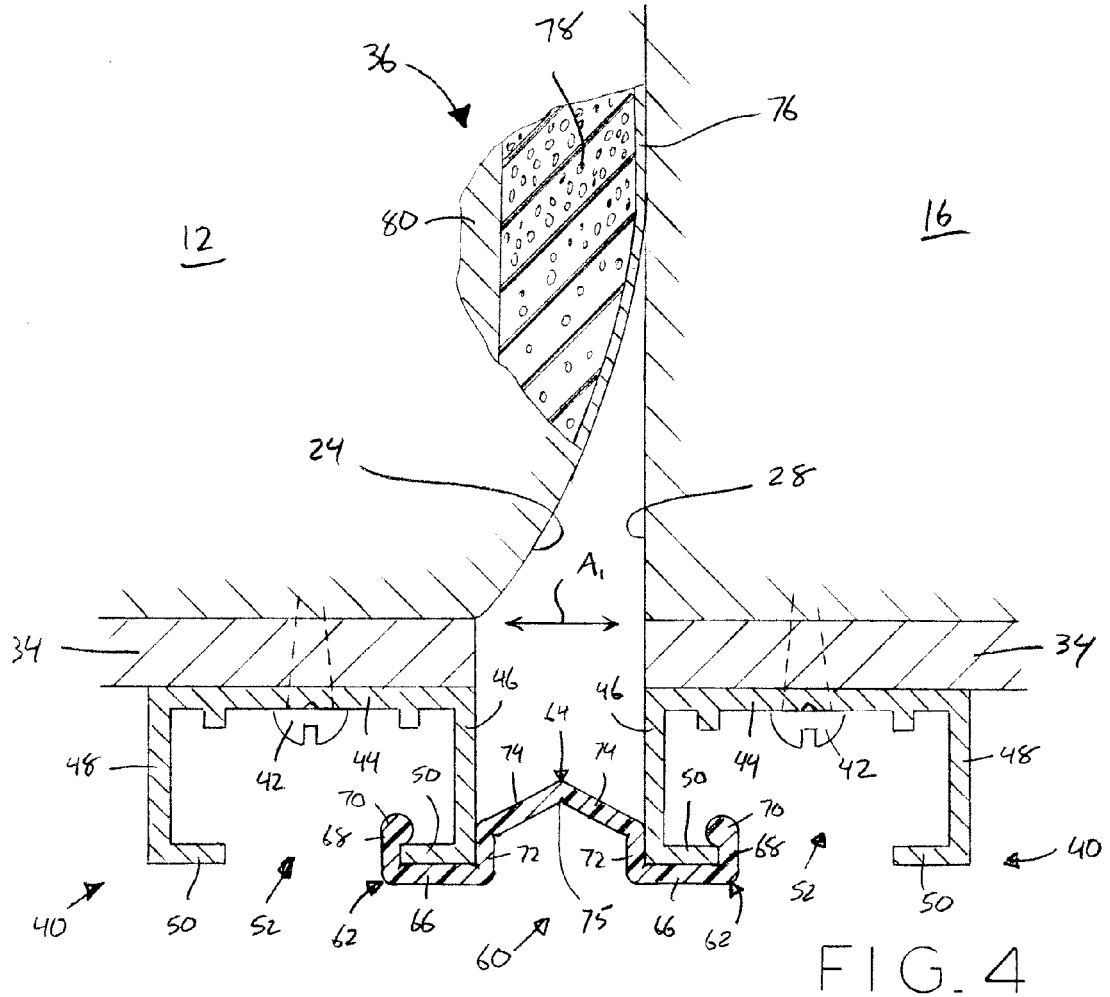
FIG. 4 is a sectional view taken along line 4-4 of FIG. 2, illustrating completed installation of the connector, together with compression of the upholstery of the lounge to generate a separation force between the lounge and table that aids in maintaining the connector in the installed condition.

Additionally, referring to FIG. 4, during and after installation of connector 60 in the manner shown and as described above, the upholstery 36 of lounge 12 may be compressed against the side 28 of table 16. The upholstery 36 of lounge 12 may include an outer cover 76 made of fabric or leather, for example, which is disposed over a compressible material 78 such as a foam or batting, which is in turn received over the solid frame 80 of lounge 12, which may be made of wood or any other rigid material, for example. As designated by arrow $A_1$ in FIG. 4, the compression of upholstery 36 of lounge 12 generates a separation force between the sides 24 and 28 of lounge 12 and table 16, respectively, which force is restrained by connector 60 and, due to the structure of the connection between connector 60 and channels 40 described above, this separation force aids in maintaining connector 60 in its installed condition in secure engagement with channels 40 due to the engagement of beads 70 of side portions 62 of connector 60 around inwardly-depending lip portions 50 of outer walls 48 of channel 40.

Figure 5:
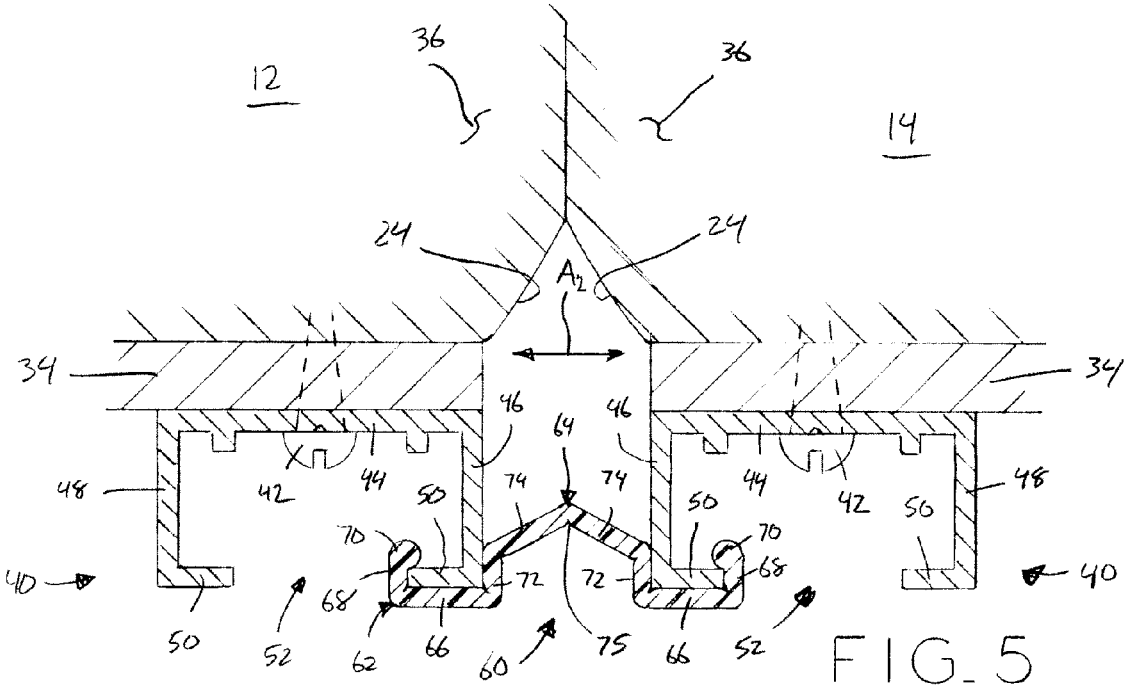
FIG. 5 is another sectional view corresponding to that of FIG. 4, illustrating the compression of the upholsteries of a pair of adjacent lounges, which generates a separation force between the lounges that aids in maintaining the connector in the installed condition.

Referring to FIG. 5, a potentially greater separation force, designated by arrow $A_2$ in FIG. 5, may be generated when a pair of lounges 12 and 14 are connected to one another by connector 60 in abutting engagement, such that the upholsteries 36 of lounges 12 and 14 are compressed against each other to generate the separation force which is restrained by connector 60 and aids in maintaining connector 60 in its installed condition in secure engagement with channels 40 of lounges 12 and 14.

Advantageously, as described above and shown in FIGS. 3-5, connector 60 may therefore be easily installed within channels 40 of adjacent articles or furniture to join the furniture articles along their sides without the use of tools and/or any other fasteners, thereby facilitating easy assembly of furniture arrangement 10 or any extensions and/or reconfigurations of furniture arrangement 10 that may be desired.

Figure 6:
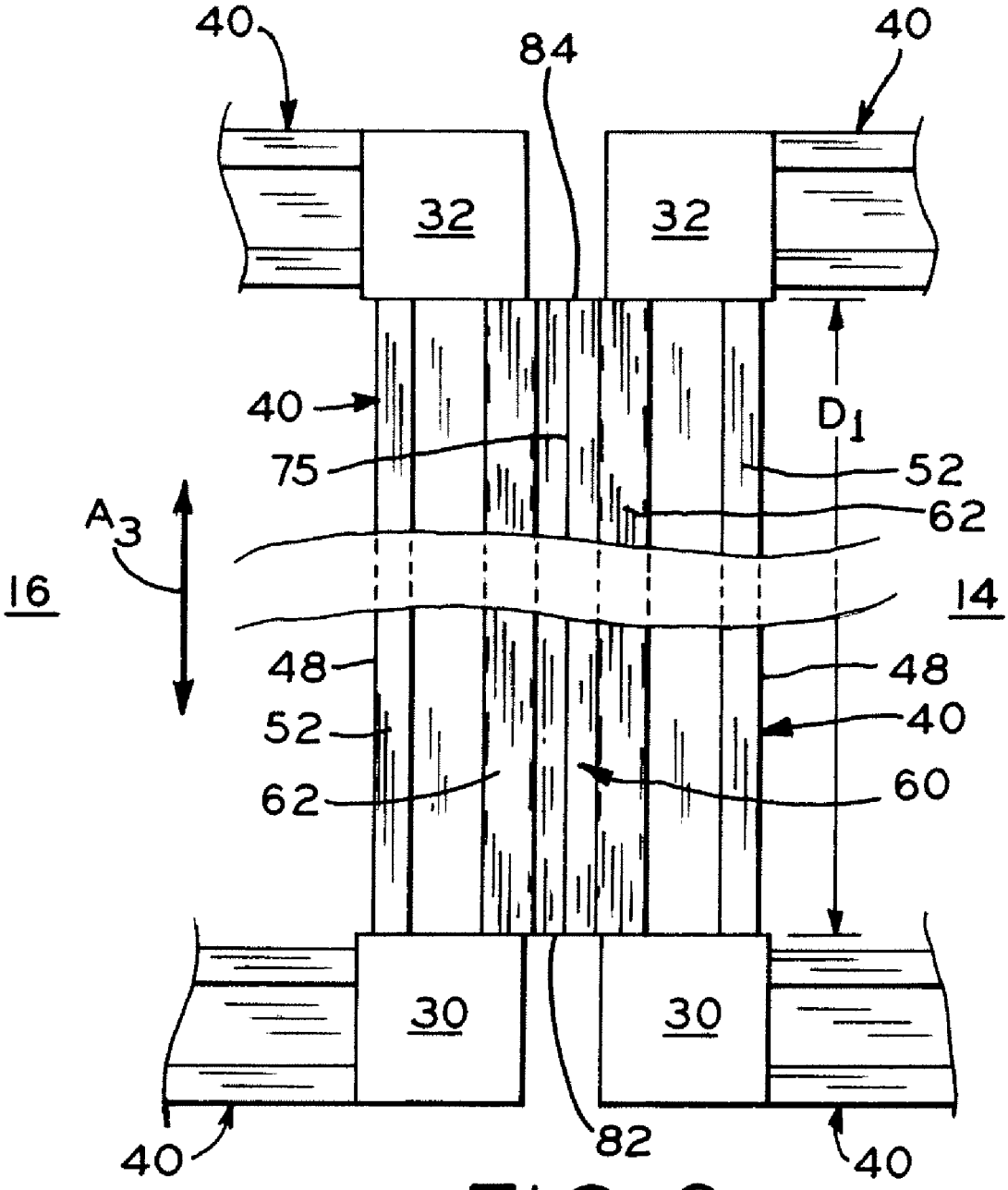
FIG. 6 is an enlarged fragmentary view of a portion of FIG. 2, illustrating the dimensioning of the connector to be substantially the same as the length of the channels between respective front and rear legs of the adjacent articles of furniture.

Referring additionally to FIG. 6, other advantages of the connecting arrangement disclosed herein are shown. As shown in FIG. 6, channels 40 of lounges 12 and 14 and/or tables extend between, and may directly abut, respective pairs of front and rear legs 30 and 32, respectively, which are separated by a distance D1. Connector 60 may have a front end 82 and a rear end 84 and may be dimensioned to have a length substantially equal to distance D1 between the front and rear ends 82 and 84 such that, after connector 60 is installed to connect adjacent articles of furniture as described above, connector 60 fits closely between, and may also make contact with or abut, the front and rear legs 30 and 32 of the adjoining articles of furniture. The respective engagement of the front or rear ends 82 and 84 of connector 60 with front or rear legs 30 and 32 of the articles of furniture restrains relative movement of the articles of furniture with respect to one another along a direction A3, which is parallel to channels 40, to thereby prevent separation of the articles of furniture in a front-to-back direction and maintain the alignment and connection of the articles of furniture to one another in a row, as shown in FIG. 1.

Figures 1A, 1B:
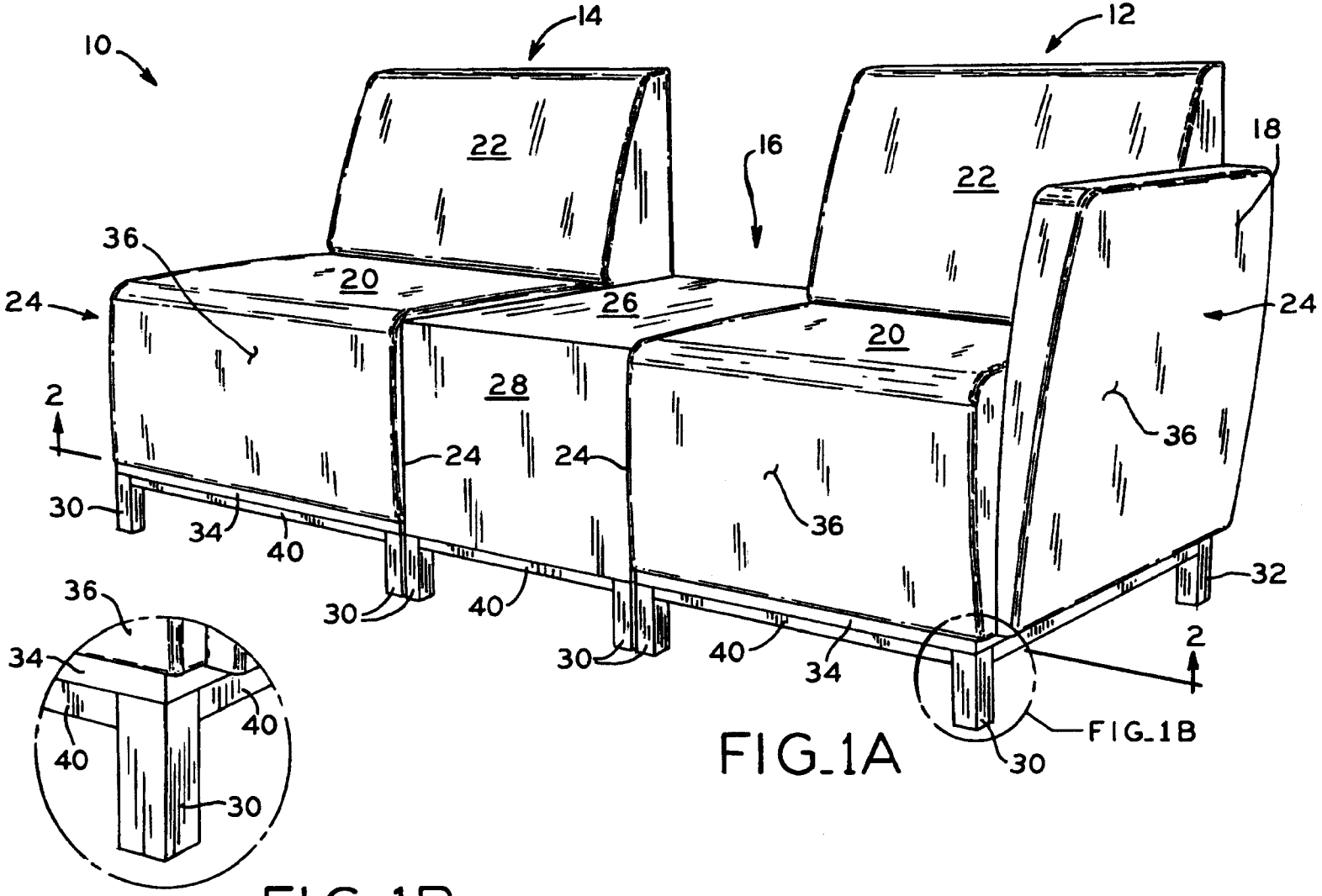
Figure 2:
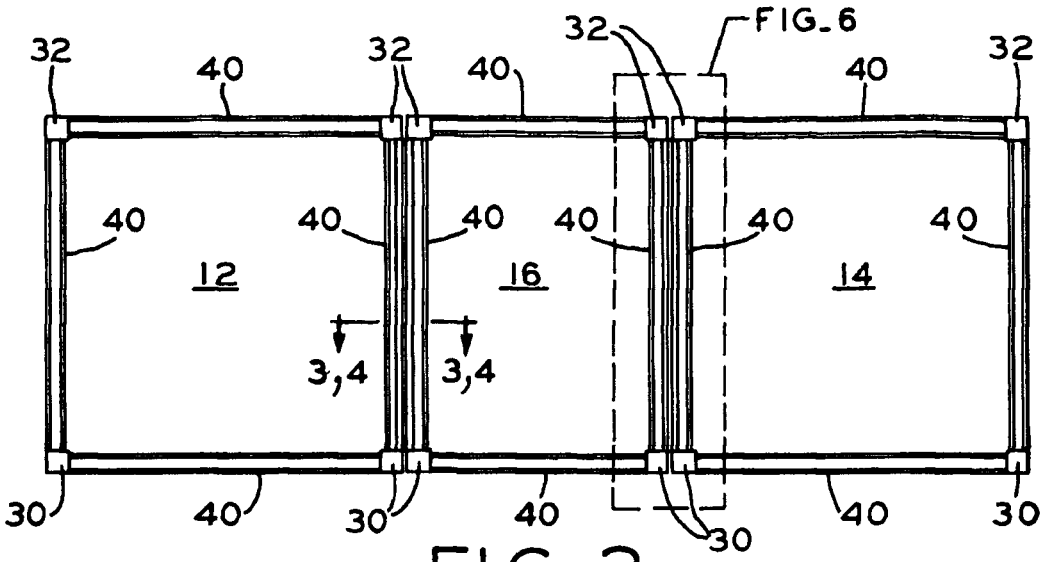
Figure 3:
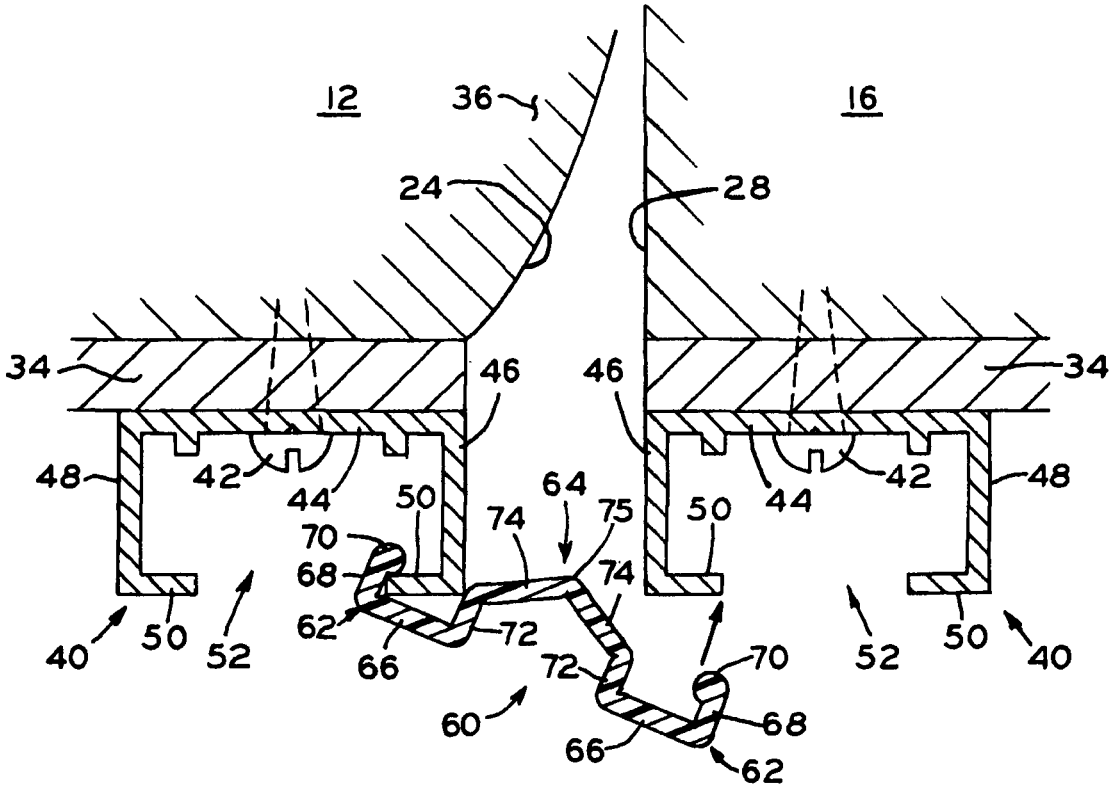
Figure 4:
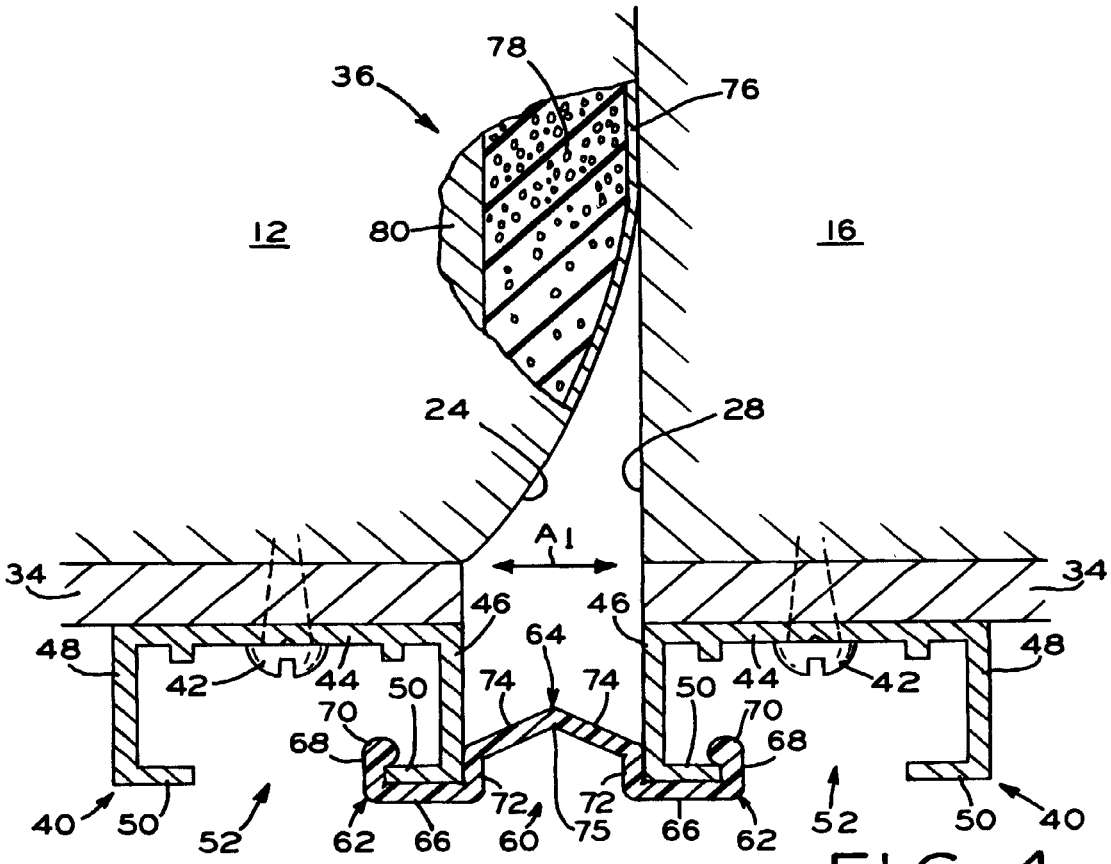
Figure 5:
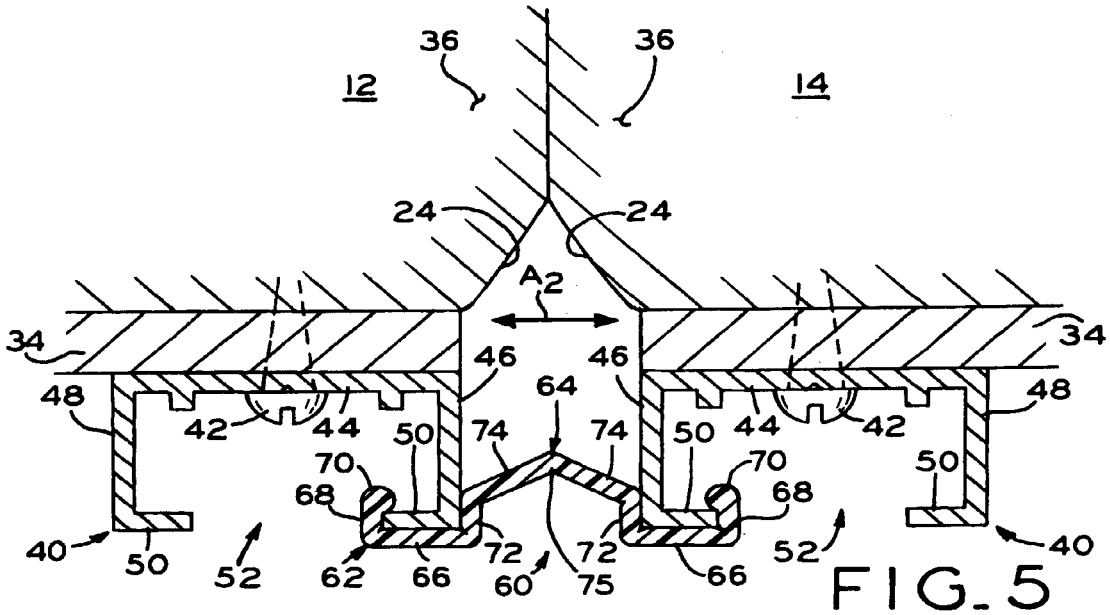

Finally, as may be seen from FIG. 6, and from FIG. 1, the engagement of connector 60 within channels 40, and the location of connector 60 between front and rear legs 30 and 32 and beneath the adjoining articles of furniture also advantageously visually hides connector 60 from view when connector 60 is installed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A furniture assembly, comprising:

a first article of furniture including a first side, and a lower portion having a downwardly-opening first channel adjacent said first side;

a second article of furniture including a second side, and a lower portion having a downwardly-opening second channel adjacent said second side, said first and second sides of said first and second articles of furniture disposed adjacent one another and said first and second channels spaced from one another with a space between said first and second channels; and a connector comprising a component separate from, and not fastened to, said first or second articles of furniture, said connector spanning said space between said first and second channels and having an upwardly projecting central portion disposed within said space, said connector having opposite side portions in respective engagement with said first and second channels.

2. The furniture assembly of claim 1, wherein said first side of said first article of furniture includes compressible upholstery, said upholstery in compressive abutment with said second side of said second article of furniture, whereby a separating force between said first and second articles of furniture is generated, the separating force restrained by said connector.

3. The furniture assembly of claim 1, wherein said first and second sides of said first and second articles of furniture each include compressible upholstery, said compressive upholsteries in compressive abutment with one another, whereby a separating force between said first and second articles of furniture is generated, the separating force restrained by said connector.

4. The furniture assembly of claim 1, wherein said connector is elongate, and is formed of a flexible plastic material.

5. A furniture assembly, comprising:

a first article of furniture including a first side, and a lower portion having a downwardly-opening first channel adjacent said first side;

a second article of furniture including a second side, and a lower portion having a downwardly-opening second channel adjacent said second side, said first and second sides of said first and second articles of furniture disposed adjacent one another and said first and second channels spaced from one another with a space between said first and second channels, said first and second articles of furniture each include front and rear legs, said first and second channels each extending between a respective pair of said front and rear legs; and a connector comprising a component separate from, and not fastened to, said first or second articles of furniture, said connector spanning said space between said first and second channels and having a central portion disposed within said space, said connector having opposite side portions in respective engagement with said first and second channels, said connector having a front end, a rear end, and a length between said front and rear ends substantially equal to a length of said first and second channels, whereby said front end is engageable with said front leg of one of said first and second articles of furniture and said rear end is engageable with said rear leg of the other of said first and second articles of furniture to restrain relative movement between said first and second articles of furniture along a direction parallel to said first and second channels.

6. A furniture assembly, comprising:

a first article of furniture including a first side, and a lower portion having a downwardly-opening first channel adjacent said first side;

a second article of furniture including a second side, and a lower portion having a downwardly-opening second channel adjacent said second side, said first and second sides of said first and second articles of furniture disposed adjacent one another and said first and second channels spaced from one another with a space between said first and second channels, said first and second channels each include lower edges with inwardly-depending lip portions; and a connector comprising a component separate from, and not fastened to, said first or second articles of furniture, said connector spanning said space between said first and second channels and having a central portion disposed within said space, said connector having opposite side portions in respective engagement with said first and second channels, said side portions of said connector in respective engagement around said inwardly-depending lip portions of said first and second channels.

7. The furniture assembly of claim 6, wherein said side portions of said connector have profiles that are complementary to said inwardly-depending lip portions of said channels.

8. A furniture assembly, comprising:

a first article of furniture including a first side having compressible upholstery, and a lower portion having an elongate first channel extending along said first side;

a second article of furniture including a second side, and a lower portion having an elongate second channel extending along said second side, said upholstery of said first side of said first article of furniture in compressive abutment with said second side of said second article of furniture;

a connector comprising a component separate from, and not fastened to, said first or second articles of furniture, said connector having an elongated profile with a substantially U-shaped cross section and spanning a distance between said first and second channels, said connector having opposite side portions in respective engagement with said first and second channels, and said connector having a front end, a rear end, and a length between said front and rear ends substantially equal to a length of said first and second channels, wherein said first and second channels are downwardly-opening and include lower edges with inwardly-depending lip portions, said connector including opposite side portions in respective engagement around said inwardly-depending lip portions of said first and second channels; and whereby a separating force between said first and second articles of furniture is generated by the compressive abutment of said upholstery of said first article of furniture with said second side of said second article of furniture, the separating force restrained by said connector, and whereby the separation force aids in maintaining said connector in engagement with said first and second channels.

9. The furniture assembly of claim 8, wherein said side portions of said connector have profiles that are complementary to said inwardly-depending lip portions of said channels.

10. The furniture assembly of claim 9, wherein each of said first and second sides of said first and second articles of furniture include compressible upholstery, said compressive upholsteries in compressive abutment with one another, whereby a separating force between said first and second articles of furniture is generated, the separating force restrained by said connector.

11. The furniture assembly of claim 8, wherein said connector is formed of a flexible plastic material.

12. A furniture assembly, comprising:

a first article of furniture including a first side having compressible upholstery, and a lower portion having an elongate first channel extending along said first side;

a second article of furniture including a second side, and a lower portion having an elongate second channel extending along said second side, said upholstery of said first side of said first article of furniture in compressive abutment with said second side of said second article of furniture, said first and second articles of furniture each include front and rear legs, said first and second channels each extending between a respective pair of said front and rear legs, a connector comprising a component separate from, and not fastened to, said first or second articles of furniture, said connector having an elongated profile with a substantially U-shaped cross section and spanning a distance between said first and second channels, said connector having opposite side portions in respective engagement with said first and second channels, and said connector having a front end, a rear end, and a length between said front and rear ends substantially equal to a length of said first and second channels, said connector having a front end, a rear end, and a length between said front and rear ends substantially equal to a length of said first and second channels, whereby said front end is engageable with said front leg of one of said first and second articles of furniture and said rear end is engageable with said rear leg of the other of said first and second articles of furniture to restrain relative movement between said first and second articles of furniture along a direction parallel to said first and second channels.

13. A furniture assembly, comprising:

a first article of furniture including a first side with a lower portion having front and rear legs, and a first channel adjacent said first side and extending between said front and rear legs;

a second article of furniture including a second side with a lower portion having front and rear legs, and a second channel extending between said front and rear legs, said first and second sides of said first and second articles of furniture disposed adjacent one another;

said first and second channels each having a lower edge with a substantially horizontal, inwardly-depending lip portion; and a connector spanning a distance between said first and second channels and having opposite side portions in respective engagement with said lip portions of said first and second channels, said connector having a front end, a rear end, and a length between said front and rear ends substantially equal to a length of said first and second channels, whereby said front end is engageable with said front leg of one of said first and second articles of furniture and said rear end is engageable with said rear leg of the other of said first and second articles of furniture to restrain relative movement of said first and second articles of furniture along a direction parallel to said first and second channels.

14. The furniture assembly of claim 13, wherein said side portions of said connector are in respective engagement around said inwardly-depending lip portions of said first and second channels.

15. The furniture assembly of claim 14, wherein said side portions of said connector have profiles that are complementary to said inwardly-depending portions of said channels.

16. The furniture assembly of claim 13, wherein said connector is elongate, and is formed of a flexible plastic material.

17. A furniture assembly, comprising:

a first article of furniture including a first side, and a lower portion having a downwardly-opening first channel adjacent said first side;

a second article of furniture including a second side, and a lower portion having a downwardly-opening second channel adjacent said second side, said first and second sides of said first and second articles of furniture disposed adjacent one another and said first and second channels spaced from one another with a space between said first and second channels; and a connector comprising a component separate from, and not fastened to, said first or second articles of furniture, said connector spanning said space between said first and second channels and having a central portion disposed within said space, said connector having opposite side portions in respective engagement with said first and second channels, at least one of said opposite side portions comprises a bead and at least one of said first and second channels comprises an inwardly-depending lip portion, said bead in engagement with said inwardly-depending lip portion.

* * * * *

UNITED STATES PATENT AND TRADEMARK OFFICE

CERTIFICATE OF CORRECTION

PATENT NO. : 7,806,474 B2
APPLICATION NO. : 12/353630
DATED : October 5, 2010
INVENTOR(S) : Mark A. Wahl et al.

It is certified that error appears in the above-identified patent and that said Letters Patent is hereby corrected as shown below:

The title page showing the illustrative figure should be deleted to be replaced with the attached title page.

The drawing sheets, consisting of Figs. 1A-5, should be deleted to be replaced with the drawing sheets, consisting of Figs. 1A-5, as shown on the attached page.

Signed and Sealed this

Seventh Day of December, 2010

David J. Kappos

David J. Kappos
*Director of the United States Patent and Trademark Office*

(12) United States Patent
Wahl et al.

(10) Patent No.: US 7,806,474 B2
(45) Date of Patent: Oct. 5, 2010

(54) CONNECTING ARRANGEMENT FOR ARTICLES OF FURNITURE

(75) Inventors: Mark A. Wahl, Gentryville, IN (US); Joshua A. Peter, Jasper, IN (US); Joshua R. Butcher, Washington, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 12/353,630

(22) Filed: Jan. 14, 2009

(65) Prior Publication Data

US 2010/0176634 A1 Jul. 15, 2010

(51) Int. Cl.
*A47C 1/124* (2006.01)

(52) U.S. Cl. ..... 297/248

(58) Field of Classification Search ..... 297/248, 297/440.1

See application file for complete search history.

(56) References Cited

U.S. PATENT DOCUMENTS

| | | | | | |
|---|---|---|---|---|---|
| 2,466,204 | A | * | 4/1949 | Brown | 297/115 |
| 3,011,227 | A | * | 12/1961 | Vogel | 297/248 |
| 3,614,158 | A | | 10/1971 | Mohr | |
| 3,637,256 | A | * | 1/1972 | Harty | 297/248 |
| 3,669,494 | A | * | 6/1972 | Lohmeyer | 297/440.14 |
| 3,742,869 | A | | 7/1973 | Polsky et al. | |
| 3,841,701 | A | | 10/1974 | Sullivan | |
| 3,944,281 | A | * | 3/1976 | Piretti | 297/440.14 |
| 4,077,666 | A | * | 3/1978 | Heumann | 297/440.14 |
| 4,591,289 | A | | 5/1986 | Vickers et al. | |
| 4,668,011 | A | * | 5/1987 | Fister, Jr. | 297/218.5 |
| 4,802,422 | A | | 2/1989 | Beard | |
| 4,978,168 | A | | 12/1990 | Piretti | |
| 5,259,165 | A | | 11/1993 | Koyama | |
| 5,282,669 | A | | 2/1994 | Barile | |
| 5,352,017 | A | | 10/1994 | Berning | |
| 5,544,938 | A | | 8/1996 | Saul et al. | |
| 5,673,881 | A | | 10/1997 | Minchey et al. | |
| 5,857,742 | A | * | 1/1999 | Karl et al. | 297/248 |
| 5,957,530 | A | | 9/1999 | Gutgsell | |
| 6,048,127 | A | | 4/2000 | Kern et al. | |
| 6,485,219 | B1 | | 11/2002 | Beyer et al. | |
| 6,543,845 | B2 | | 4/2003 | Seitz et al. | |
| 6,749,259 | B2 | | 6/2004 | Ware et al. | |

(Continued)

*Primary Examiner*—Peter R. Brown
(74) *Attorney, Agent, or Firm*—Baker & Daniels LLP

(57) ABSTRACT

A connecting arrangement for articles of furniture, such as seating furniture and/or tables of the type used in an office environment. A pair of articles of furniture are positioned adjacent to one another, each including a downwardly-opening channel along a lower portion of its side. An elongate connector spans the distance between the channels and has opposite side portions in respective engagement with the channels to connect the furniture articles together in a manner wherein the connector may be visually hidden in use. If one, or both, of the connected articles of furniture includes upholstered sides, the upholstery is compressed upon abutting engagement of the articles of furniture to generate a separation force which is resisted by the connector and aids in maintaining the connector in secure engagement with the channels of the adjacent articles of furniture. The connector may have substantially the same length as a distance between front and rear legs of the articles of furniture, such that the connector is engageable with the front and/or rear legs to restrain movement of the articles of furniture in a front-to-back direction with respect to one another.

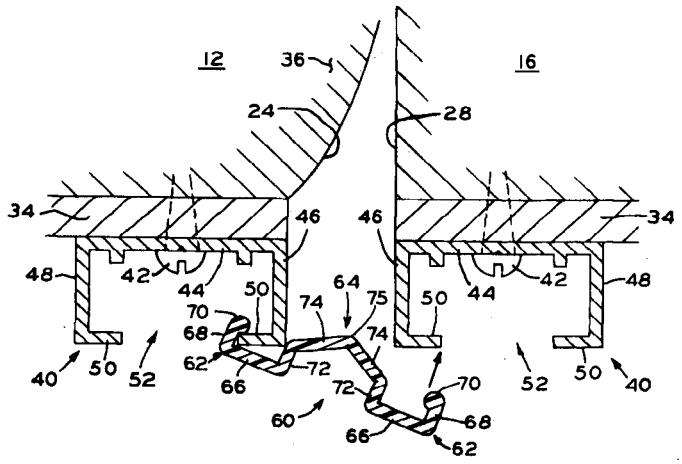

17 Claims, 4 Drawing Sheets